US006413635B1

(12) United States Patent
Martin et al.

(10) Patent No.: US 6,413,635 B1
(45) Date of Patent: Jul. 2, 2002

(54) ELASTIC NYLON YARNS

(75) Inventors: Donald H. Martin, Pensacola; L. Peter Williams, Jr.; Richard A. Dunbar, both of Gulf Breeze, all of FL (US)

(73) Assignee: Solutia Inc., St. Louis, MO (US)

( * ) Notice: Subject to any disclaimer, the term of this patent is extended or adjusted under 35 U.S.C. 154(b) by 0 days.

(21) Appl. No.: 09/625,238

(22) Filed: Jul. 25, 2000

(51) Int. Cl.[7] ..... D02G 3/00
(52) U.S. Cl. ..... 428/372
(58) Field of Search ..... 428/364, 357, 428/370, 373

(56) References Cited

U.S. PATENT DOCUMENTS

| | | | | |
|---|---|---|---|---|
| 3,399,108 A | | 8/1968 | Olson | 161/173 |
| 3,558,760 A | * | 1/1971 | Olson | 264/168 |
| 3,607,610 A | | 9/1971 | Fukuma et al. | 161/173 |
| 3,667,207 A | | 6/1972 | Ben et al. | 57/140 |
| 3,779,853 A | | 12/1973 | Olson | 161/70 |
| 3,901,989 A | | 8/1975 | Hokonoki et al. | 428/373 |
| 4,069,363 A | | 1/1978 | Segraves et al. | 428/224 |
| 4,106,313 A | | 8/1978 | Boe | 66/202 |
| 4,521,484 A | | 6/1985 | Li | 428/374 |
| 4,601,949 A | | 7/1986 | Bach et al. | 428/374 |
| 4,740,339 A | | 4/1988 | Bach et al. | 264/168 |

FOREIGN PATENT DOCUMENTS

GB 1322621 * 7/1973

OTHER PUBLICATIONS

Anonymous, "Polyamide bicomponent fibers," Research Disclosure, May, 1980.

* cited by examiner

*Primary Examiner*—N Edwards
(74) *Attorney, Agent, or Firm*—Howrey Simon Arnold & White, LLP

(57) ABSTRACT

The invention is a side by side nylon/nylon bicomponent yarn with desirable stretch and recovery and retractive force characteristics, and the process for manufacturing this yarn.

18 Claims, No Drawings

ELASTIC NYLON YARNS

BACKGROUND OF THE INVENTION

Historically, the textiles industry has increasingly utilized textile yarns which can provide useful levels of stretch and recovery in final fabric or garment form. This trend has been evident over the past 50 years from the advent and use of texturing processes to make polyester yarns for stretch woven fabrics, texturing processes to make stretch nylon yarns for a variety of high stretch knitted fabrics and by the utilization of technology for polymer compositions such as the segmented polyurethanes used to make fibers with inherently high stretch and recovery characteristics.

The approaches to increased stretch and recovery in textile yarns can be categorized in several different ways including categorization via the three technological approaches of 1) texturing processes, 2) compositions, and 3) engineered fibers.

Major examples in category 1 include the technology of single heater friction false twist texturing processes to make polyester yarns for use in stretch woven fabrics. Also included in category 1 are different texturing processes (including friction false twist texturing) to make continuous filament nylon yarns which are used in many applications such as the stretch component in men's socks, in stretch fabrics such as ski wear and in ladies' stretch hosiery.

In category 2 of fiber compositions are those such as fibers and yarns made from the elastomeric segmented polyurethanes which, when utilized in fiber form, are referred to as spandex fibers and yarns.

In category 3, engineered fibers, are several different yarns and technologies for making them. Among the more useful are bicomponent fiber technologies. Such fibers have been known for many years and can be made over a composition range having a wide range of stretch and recovery characteristics. Technology for manufacturing a nylon/nylon bicomponent fiber with a relatively low range of stretch and recovery, useful for stretch hosiery, is described in U.S. Pat. No. 3,399,108. Similar bicomponent yarns for stretch hosiery are also described in U.S. Pat. No. 3,901,989.

A significantly higher range of stretch and recovery suitable for support hosiery is achieved in side by side bicomponent spinning of nylon polymer with a polyurethane polymer described in publications "Monvelle: New Yarn for Support Hosiery", Knitting Times, Nov. 5, 1973, and in "Biconstituent Fibers from Segmented Polyurethanes and Nylon 6", J. of Appl. Polym. Sci., v 19, pp 1387–1401, 1975, and in U.S. Pat. No. 3 4,106,313.

The bicomponent fibers in category 3 derive their properties from the dissimilar properties of the side by side components. One such combination is nylon and polyurethane. The optimal retraction of both components is usually actuated by a treatment process which is often a heating step such as steaming or a scouring step or a dyeing step in the fabric or garment finishing process. In the actuation (also called bulking), step such fibers develop a helical crimp due to the difference in retraction of the two components. This effect is often described as following the model of bimetal thermostats and is well known in the art and described in many publications such as "Mechanical Principles of Natural Crimp of Fiber", R. Brand and S. Backer, Textile Research Journal, pp. 39–51, 1962.

In many applications, additional demands are made upon yarns to provide, in addition to high levels of stretch and recovery, relatively high force levels as the yarn retracts from extension. This high retraction force translates to a force exerted by the fabric or garment made with such yarns. Such requirements are, for example, illustrated by the requirement of such yarns in ladies support hosiery in which it is highly desirable that the garment exert a useful level of force (compression) upon the wearer's leg.

A corollary need is that the garment not exert an excessive level of compression at any point in the garment such as the ankle, the knee, the calf, etc. This corollary need translates to a requirement that the yarn used have a high level of extension within a useful level of stress. Most of the applications requiring such high levels of both stretch and force utilize elastic fibers such as spandex (or spandex wrapped with other fibers such as nylon) or alternatively elastic bicomponent fibers such as those made with nylon and polyurethane as described in the references noted above.

Among the most useful fiber compositions for applications requiring high stretch and recovery (such as in ladies' stretch hosiery) are the nylon fibers. Nylon fibers have several advantages over spandex fibers and over the nylon/polyurethane bicomponent fibers. Nylon fibers are more resistant to degradation by heat or by light or by exposure to bleaches such as common household bleaches containing chlorine. The nylon polymers for fiber spinning are also, in general, less costly than the polyurethanes for spandex fibers or the polyurethanes for nylon/polyurethane bicomponent fibers.

However, it has heretofore not been possible with yarns made from nylon polymers alone to achieve the high stretch and recovery in combination with high retraction force characteristic of the wrapped spandex fibers or the nylon/polyurethane bicomponent fibers. This invention describes such fibers and yarns and methods to make them.

SUMMARY OF THE INVENTION

The present invention relates to a nylon bicomponent yarn comprising one low shrinkage nylon component comprising a homopolymer or a copolymer of isomorphic monomers and one high shrinkage nylon component comprising a random copolyamide comprising at least two mutually non-isomorphic comonomer units, wherein the yarn comprises a Stress Elongation Factor of at least about 4.5 (g/den)(%).

The present invention also regards a process of manufacturing a nylon bicomponent yarn by providing a low shrinkage nylon polymer, the low shrinkage nylon polymer comprising a homopolymer or copolymer of isomorphic monomers; providing a high shrinkage nylon component, the high shrinkage nylon polymer comprising a random copolyamide containing at least two mutually non-isomorphic comonomer units; and, spinning the low shrinkage nylon component and the high shrinkage nylon component to form a yarn with the components being arranged in a side by side configuration , the yarn comprising a Stress Elongation Factor of at least about 4.5 (g/den)(%).

DETAILED DESCRIPTION OF THE INVENTION

As used herein, copolymer percentages are weight percent in the monomer charged to the polymerization process.

As used herein, the term "yarn" comprises one or more filaments whether continuous or staple fibers.

As used herein, the term "textile material" is any knitted, woven, pressed, non woven, or otherwise formed material made from yarn of the present invention, with or without natural or synthetic fibers or mixtures or blends thereof.

As used herein, the term "comonomer" and "comonomer units" means a monomer present at a level of at least about 4% by weight of the component monomer charge.

As used herein, the term "crystalline" means the polymer exhibits regions of three dimensional order as interpreted by various means such as by x-ray diffraction, differential scanning calorimetry, density, and other methods known to the art.

As used herein, the term "isomorphic comonomers" is used as is customary in the industry, that is, comonomers that are capable of replacing each other in crystals without disrupting the crystal structure. Typically, the melting point of a composition of isomorphic comonomers will vary monotonically with no minimum over the composition range. For a more complete discussion of isomorphic comonomers, see, for example, Billmeyer, Textbook of Polymer Science, 3rd edition (1984), page 336.

As used herein, the term "non-isomorphic comonomers" means comonomers that disrupt a crystalline structure, typically because the comonomer size and shape does not allow the comonomer to fit into the crystalline structure of the other comonomers.

It is obvious, of course, that a particular comonomer may be isomorphic in one combination of comonomers and non-isomorphic in a second set of comonomers.

As used herein, the term "side-by-side" bicomponent means essentially side by side as is used in the art, including eccentric configurations.

The invention is a nylon/nylon bicomponent yarn with desirable (but hitherto unattainable) stretch and recovery and retractive force characteristics, and the process for manufacturing this yarn.

These characteristics of stretch and recovery and retractive force are quantifiable through a yarn test in which the stress on the yarn is measured as it is extended through 3 cycles of extension and retraction. From the results of this 3 cycle test can be calculated the important factors of stress at extension levels, hysteresis loss, peak stress decay and yarn fatigue all of which are important characteristics of elastomeric yarns. All of these important characteristics are embodied and quantified in a parameter termed the "Stress Elongation Factor" which can be calculated from measurements in the 3 cycle extension test. The Stress Elongation Factor correlates with the yam's performance in several end use fabrics such as ladies hosiery.

This invention describes compositions and processes to make nylon bicomponent yarns with hitherto unachieved levels of Stress Elongation Factor characteristics. Even though other configurations may be utilized (e.g., off center sheath-core), the yarn comprises one or more filaments, wherein said filament (or filaments) is comprised of a low shrinkage component that is spun with a high shrinkage component. The spinning is preferably in an essentially side by side configuration, in which the low shrinkage and high shrinkage components are joined as melts.

The major parameters which govern the Stress Elongation Factors of the yarns of this invention are the composition of the high and low shrinkage polymers, their relative amounts, the high and low shrinkage polymer molecular weights, the denier and number of filaments of the yams made and the spinning and drawing process for making the yams.

The low shrinkage nylon component comprises a homopolymer or a random copolymer of isomorphic comonomers. As used herein, the phrase "copolymer of isomorphic comonomers" is intended to encompass a homopolymer unless the context of the sentence indicates otherwise.

The nylon polymers suitable for making the fibers of this invention include those from diacids with diamines such as nylon 6,6; nylon 6,9; nylon 6,10; nylon 6,12 , all of which are made with the C6 hexamethylene diamine, and the various diacids of 6 or 9 or 10 or 12 carbon diacids respectively, as well as other nylons such as nylon 12,6; nylon 12,9; nylon 12,10; or nylon 12,12 all of which are made with the C12 diamine, dodecanediamine. In addition to the nylons made via the route of diacids plus diamines are those nylons made by the use of aminocarboxylic acid monomers or lactams such as the polymer of caprolactam (to make a nylon 6 unit) or ω aminoundecanoic acid (to make a nylon 11 unit) or dodecanelactam (to make a nylon 12 unit). This list is for illustration but does not limit the nylon components. One of ordinary skill in the art should know how to commercially obtain these nylon polymers or make them from monomers which are commercially available from numerous sources.

The nylon monomers can be used in any chemical combination desired for the particular practice of this invention, however, it will be recognized by those skilled in the art that the final properties of the fiber or yarn are influenced by which monomers are selected for the polymers for both the low and high shrinkage fibers.

A representative combination of isomorphic comonomers include nylon 6,6 (hexamethylenediammonium adipate) and nylon 6, TA (hexamethylenediammonium terephthalate). Another representative combination includes nylon 6,6 and nylon 6, HHTA (hexamethylenediammonium hexahydroterephthalate). Combinations of these monomers will form a random copolymer of isomorphic comonomers, for example, a polymer formed from a combination of nylon 6, TA, nylon 6, HHTA, and nylon 6,6. Other combinations of isomorphic nylon comonomers are known in the art.

It is recognized that a low shrinkage nylon component could be formed from a mixture consisting essentially of isomorphic comonomers, with small percentages of non-isomorphic comonomers. The specific quantity of non-isomorphic comonomers that will result in a loss of the desired properties depends on the particular comonomers in the copolymer.

Also included within the scope of the low shrinkage component are nylon polymers made from blocks of isomorphic nylon comonomers, wherein the effect is to give a low shrinkage component, even though the blocks of isomorphic comonomers may not be isomorphic with the comonomers in other blocks. For example, a polymer made of blocks of non-isomorphic comonomers may well provide a low shrinkage component wherein a random copolymer with the same overall composition will not provide the low shrinkage component encompassed by the claims. The degree of randomness influences shrinkage.

As used herein, the term "block of comonomers" means a unit comprising at least about 10, typically at least about 50, comonomer units in a separate unit, wherein the unit is then incorporated into a copolymer with other comonomers or blocks of comonomers.

One or more of the monomers used in making the low shrinkage polymer fiber can be, but is not necessarily, used as a component in the non-isomorphic copolymer. The high shrinkage nylon component comprises a random copolyamide containing at least two mutually non-isomorphic comonomer units. In one preferred embodiment the high shrinkage nylon copolymer has no component (monomer) at greater than about 65% by weight. In a preferred embodiment, the high shrinkage nylon component comprises a random copolyamide containing at least three mutually non-isomorphic comonomer units. An example is a random copolymer comprising nylon 6,6/nylon 6/nylon 6,9 in the ratio by weight of 65%/17.5%/17.5%. In another preferred embodiment, the high shrinkage nylon component comprises a random copolyamide containing at least four mutually non-isomorphic comonomer units. One example is a random copolymer comprising nylon 6,6/nylon 6/nylon 6,9/nylon 6,10 in the weight ratio of 49.1%: 7.8%: 21.1%: 21.9.

As used herein, the term "random" means the copolymer typically shows only one melting point peak. Such a melting point peak may, however, be very broad and not well defined. Given the benefit of this disclosure, one skilled in the art would recognize that increased randomness generally results in increased shrinkage in non-isomorphic copolymers.

It has been found that the composition of the non-isomorphic copolymer is important to the properties of the non-isomorphic copolymer. A convenient method of defining the composition is by the level of the majority component (monomer) and by the levels of the remaining components (monomers) in each copolymer.

The shrinkage or retraction difference between the low shrinkage and high shrinkage components of the drawn fibers made with the polymers of this invention are crucial to the high level of performance achieved in these fibers. One of the major factors governing the shrinkage or retraction level of the non-isomorphic copolymer is the concentration of the major component (monomer)—that component present at the highest concentration. To achieve the very high shrinkage levels needed for this invention, in a preferred embodiment the concentration of the major component (monomer) of the copolymer should be less than about 65%, more preferably less than about 60%, and even more preferably less than about 55% by weight. Such levels will, in general, produce boiling water shrinkages for fibers made from the copolymers alone of at least about 40%.

It is obvious to those knowledgeable in the art that for copolymers made from non-isomorphous comonomers, such as those described above, the composition ranges utilized for each component would be a major factor in achieving the desired copolymer properties.

We have found that a useful parameter is the minimum concentration (expressed as weight % of monomer) of the least abundant component. This minimum concentration is dependent upon the number of components and can be calculated as $$\text{Component Minimum}=[\text{Composition Index}]\times[1000]\times[(n)\exp -4.5]$$

where

CI the Composition Index n=the number of copolymer components, where n=3.

In this work we have found that a Composition Index of about 2.3 yields copolymers with desirable and useful properties. As an example, applying this equation to a 3 component polymer (n=3) then yields a minimum concentration for the least abundant component of about 15%.

Typically, excellent results are obtained when the non-isomorphic comonomers are present in the high shrinkage copolymer at concentrations as follows, where the concentration of comonomer A is greater than or equal to the concentration of comonomer B; the concentration of comonomer B is greater than or equal to the concentration of comonomer C; the concentration of comonomer C is greater than or equal to the concentration of comonomer D; and so on.

For a three comonomer high shrinkage copolymer, comonomer A is between 33.3 and 65 weight percent, comonomer B is between about 17.5 and about 42.5 weight percent, and comonomer C is between about 15 and about 33.3 weight percent. For a four comonomer high shrinkage copolymer, comonomer A is between 25 and 65 weight percent, comonomer B is between about 11.7 and about 46 weight percent, comonomer C is between about 4 and about 32 weight percent, and comonomer D is between about 4 and 25 weight percent.

High shrinkage copolymers containing five, six, seven, eight, nine, or more comonomers can be made which also fit into the claimed ranges. Calculation of the claimed ranges should be apparent to one skilled in the art in light of this disclosure.

For purposes of this work a monomer is considered a component only if it is present at a level of at least 4% by weight of the component monomer charge.

The fibers spun and drawn from the high shrinkage copolymers alone are characterized in having high levels of boiling water shrinkage: minimally about 40%, more preferably about 48% and most preferably about 55% or higher. For the non-isomorphic polymer, isomorphic comonomers are generally treated as being one comonomer. For example, a non-isomorphic copolymer may be formed from 31% nylon 6,6 and 31% nylon 6, TA, even though these are isomorphic comonomers, provided there are other non-isomorphic comonomers, for example 19% nylon 6,9 and 19% nylon 6,10, present at or above the required concentration.

With respect to compositions, it will be noted by those skilled in the art that the preferred embodiments of the high shrinkage copolymer composition, that is, 1) no comonomer present at greater than about 65% by weight, and 2) the additional two or more comonomers be both non-isomorphous with themselves and with the first comonomer and be present at the required concentrations, results in a high level of amorphous character.

Copolymers with high levels of non-isomorphous monomer content have slow rates of crystallization and/or low temperature sticking points and/or problems in fiber spinning. Processing problems and complications in fiber spinning and drawing arising from such properties are possible. In such cases, it is advantageous to use appropriate additives. One such class of additives is referred to as "anti-blocking" or "anti-sticking" agents. Of particular value in nylon fiber spinning with the copolymer compositions are the class of antiblocking agents made from monofunctional amides of long chain acids such as the amide made from stearic acid and ammonia or other amine. Such materials are available commercially, such as ACRAWAX C (™)(Glyco Industries, Inc.) and CARLISLE 240 WAX (™)(Carlisle Chemical Works, Inc.). Substantial improvements in copolymer spinning characteristics can be obtained by incorporating between about 0.1 to about 3%, preferably between about 0.3 and about 2%, more preferably between about 0.6 and about 1.4% by weight of polymer, of these antiblocking agents in the multicomponent copolymer. Excellent results were obtained in an example with about 1% by weight of antiblocking agent in the copolymer.

Nevertheless, copolymers with a very high degree of non-isomorphic character, as might be obtained by a random polymer comprising six non-isomorphic comonomers at about 16% each, are operative but are less preferred because of spinning performance problems encountered. It is preferred that the high shrinkage copolymer have at least one comonomer present at concentrations greater than about 30%, preferably greater than about 40%, by weight. The nylon copolymers that do not follow these constraints typically require higher concentrations of antiblocking agents.

It will be recognized by those skilled in the art of side by side bicomponent fiber spinning that the relative amounts of high and low shrinkage polymers influence the properties of the final bicomponent yarn. The optimization of the ratio of high to low shrinkage polymer will depend upon the particular choice of high and low shrinkage polymer compositions.

Polymer molecular weight is also a significant polymer parameter in the practice of this invention.

The polymer molecular weights were measured indirectly via the common surrogate of solution viscosity measurements which are known to correlate with molecular weight. The relative viscosity in sulfuric acid (RVS) is the value reported. In the examples, the polymer solution viscosity in formic acid (RVF) was measured using ASTM D 789. Since a more common solvent for solution viscosity measurements worldwide is sulfuric acid, the RVF data were converted to RVS for 1 g of polymer per 100 ml of solvent in 96% sulfuric acid. The conversion is $$RVS=(0.020186\times RVF)+1.6993$$

which is applicable for RVFs above about 30.

Most nylon polymers used for spinning fibers across the broad range of apparel yarn applications, including those for friction false twist texturing, are, in general, in the range of relative viscosity (RVS) of about 2.3 to about 2.8 . However, we have found in this work that for high shrinkage polymers and copolymers having a higher concentration of the major component (for example above about 60%) one can obtain fibers that meet the preferred Stress Elongation Factor properties of this invention if polymers of high molecular weight are used. In this invention high molecular weight means solution viscosities of RVS greater than about 2.8 and preferably greater than about 3.2.

However, if the high shrinkage polymers and copolymers comprise major components (monomers) with lower concentrations (e.g., below about 55%), the Stress Elongation Factor properties of this invention may be obtained with polymers and copolymers having lower molecular weight, such as solution viscosities (RVS) of as low as about 2.3. The high and low shrinkage polymers and copolymers may have different relative viscosities (RVS), but at least one of the polymer's relative viscosity should be at least about 2.3.

Optionally, at least some of the fiber which comprises the yarn of the present invention further includes conventional additives, for example pigments such as titanium dioxide, UV stabilizers, antimicrobials such as zinc oxide, electrically conductive materials such as carbon black and known intrinsically conductive polymers such as polyaniline, and the like. Further, conventional materials such as fluorochemicals and stain resist agents may be added or applied to the fibers to impart qualities such as soiling and stain resistance.

The yarn may be manufactured by any suitable manufacturing processes. The filaments may be made via melt or solution spinning processes which include extruding the polymer in molten form or dissolved in a solvent through capillaries of a spinneret into a quench zone, or coagulation bath, or evaporative zone.

The preferred method is to melt the polymer in, for example, an extruder, or the polymer can be directly provided by a continuous polymerization process. The melting of the mixture of polymers in the process of the present invention may be carried out in conventional bicomponent melt spinning equipment at a temperature typically from about 200° C. to about 300° C. The exact temperature for any one formulation will vary in accordance with the melting point of the polymers used. The melt is then transferred to a pack under high pressure where it is typically filtered to remove solids and subjected to high shear. In general, in the pack the two polymers are then then brought together at the spinnerette and fused together in the molten state as they are extruded.

The extruded strands are cooled or quenched into solid nylon fibers which are conventionally gathered and then drawn. Spinning and drawing can be by conventional two step processes of spinning and then drawing or by a coupled process of spin draw.

As above-mentioned, the Stress Elongation Factors displayed by the yarns of the present invention distinguish over prior nylon yarns in at least two major respects: in the compositions utilized to make these yarns (as described above) and in the process (including in line heat treatments) for the drawing of the yams.

The process for the drawing of the yam differs from that of the prior art in the elimination of the heat actuated yarn prebulking step such as taught by U.S. Pat. No. 3,399,108 or U.S. Pat. No. 3,901,989. Both of these patents teach and give examples in which the yarn is subjected to a heating chamber at temperatures from about 155° to 180° C. and simultaneously allowed to crimp or "relax". This is also often described as a yarn prebulking process.

Yarn heat treatment processes can be considered under at least three different processes: (1) a process in which the yarn is allow to shrink or retract such: that the length of the yam coming out of the heating step is less than the yarn going in, (2) a process in which the yarn is heated but with no significant change in yarn length i.e. the length of the yam coming out of the process is the same as the yarn length going into the process, and finally (3) a process in which the yam coming out of the process is longer than the yarn going into the process such as that which occurs around the draw pin of a typical drawing process.

Unlike the processes described in the reference patents noted above, the yarns that possess the Stress Elongation Factors of this invention are preferably made in a process in which the yarns have a limited level of heat treating or prebulking. For, example, in terms of the three general heat treatment processes described above, preferable ranges for this invention for process type #1, temperatures should be held to no higher than about 100° C., for process type #2 temperatures should be held to no higher than about 100° C., and for process type #3 temperatures should be held to no higher than about 850°C., and more preferably no higher than about 60° C. Yarns made within these techniques are in this application defined as "Direct Wound" yarns.

While heat treatments were needed to achieve desired fiber properties in the prior art, such treatment may often be detrimental to fibers of the current invention. As noted in Examples 6 to 13 the use of heat (such as that for the heated draw pin processes in Examples 10 to 13, or heating in a prebulking process) leads to reduced Stress Elongation Factor levels and poorer yam elastic properties.

While the Direct Wound yarn process does, in general, provide somewhat higher final yam shrinkage than the processes which include prebulking as in the reference patents, the Direct Wound yam process also provides significantly improved elastic properties as noted in the data of Examples 8 and 9.

One of the desirable drawing conditions that may be utilized to make the fibers described in this invention use ambient temperature, i.e., below about 40° C., preferably ambient, i.e., between about 20° C. and about 30° C., for the rolls or, draw pins prior to the draw of the drawing process. As used herein, such yam is called Cool-Drawn Direct Wound yam. Cool-Drawn Direct Wound yam is not subject to any heat processing, such as pre-bulking, at temperatures greater than about 40° C. Examples 8 and 9 are Cool-Drawn Direct Wound yarn.

However, it will also be recognized by those skilled in the art that in some cases additional heat may be useful to improve yarn processing in the drawing or winding steps. Use of such a level of heat should be kept to a minimum and used only to the extent found necessary to achieve the desired drawing performance levels and, in certain embodiments, within the limits as described above for the Direct Wound yarn process or the Cool-Drawn Direct Wound process.

It will also be recognized by those skilled in the art that the practice of side by side bicomponent spinning has several aspects which require attention and are required for good practice.

The denier, modification ratio and cross-section of the fibers may be chosen from conventional ranges for these parameters depending on the specific end use application for the yarn of the present invention. For many applications, such as ladies hosiery leg yarns, deniers of 20–35 are preferred. As shown in this invention, for a given denier the highest Stress Elongation Factors are for 1 filament (monofilament yarns) with somewhat decreasing Stress Elongation Factors as the number of yarn filaments increases. It will be recognized by those skilled in the art that the final choice of yarn denier and number of filaments will depend upon several factors including the end use product performance and aesthetics desired.

If a pigmented stain resistant nylon fiber is desired, as opposed to a natural fiber in which there are no pigments, the addition of a wide range of both organic and inorganic pigments may be further included in the above described process of making a stain resistant nylon fiber. The pigments are generally introduced in a conventional manner in the form of a concentrate formulation containing one or more "pure" pigments. The number, color and proportions of the "pure" pigments will be based on the shade of color desired in the nylon fiber. Other factors that may affect the color of the nylon fiber include the presence of lubricant additives, extenders, fillers, flame retardants, UV-light stabilizers, antioxidants, antistatic agents, antimicrobial agents, nucleating agents and so forth. The affect of these factors on color and the fiber spinning process should be appreciated and understood by one of ordinary skill in the art.

It will be recognized by those skilled in the art that the polymer compositions (either the homopolymer or the copolymer) can be modified by the use of small amounts of an additional comonomer. Such a comonomer might be a small amount (typically less than 4% by weight) of an additive monomer such as the sodium salt of sulfo-isothphalic acid if the desire were to make the polymer composition less acid dyeable or the use of the terminating agent amino ethyl piperazine if the desire were to make the composition more acid dyeable.

It will also be recognized by those skilled in the art that the nylon polymer variants used in practicing this invention can contain one or more of several additives useful for particular applications or uses. Such additives include but are not limited to antioxidants, antiozonants and additives utilized to influence the dyeing characteristics (or other properties) of the fiber.

It is to be understood that the yam of the present invention may be a blend of two or more fibers which are different in one or more characteristics, for example polymer type, denier, cross-section, modification ratio, additive formulation and the like.

One could utilize the teaching of this invention to make useful mixed filament yarns. For example, a yam containing one filament (for example 20 denier) cospun with several very fine filaments (for example 10 filaments of 1 dpf) to achieve a final result which would combine the desirable stretch and recovery properties provided by the monofilament with the desirable softness properties provided by the fine filaments.

Crimp is one of the more important characteristics of fibers whether staple fibers or continuous filament fibers. There are a wide variety of techniques and approaches for measuring fiber crimp many of which differ significantly in the fundamental geometry and/or properties being measured.

One of the more common and useful approaches to measuring bulk, shrinkage and crimp encompasses the steps of measuring the length of a yarn under sufficient load to extend it (a high load), bulking the yam (typically by some heating process) under conditions of a load representing some end use condition (a low load), measuring the yarn length after bulking under the low load, and then finally measuring the yarn length again under a high load. It has been found in this work and in other studies that a load of about 0.33 g/den is sufficient to straighten the fiber or yarn (i.e. extend the helices in the case of helical crimp) without pulling out or permanently distorting the crimp. In general, a 0.00136 g/den load is sufficient to hold the fiber or yarn straight but does not extend or straighten to any significant degree, the crimp. i.e. the fiber or yarn retains its crimped geometry.

Such a test procedure was used in the examples herein. The following paragraphs describe the general procedures used to determine the fiber properties of the various examples.

A skein of the yarn to be tested was held fixed at one end and subjected to a load of 0.33 g/den. After 10 seconds the length of the yarn skein was measured and recorded as L1.

The yarn was then subjected to a load of 0.00136 g/den and put into a hot water bath at 100° C. for 60 seconds. The yarn was removed from the bath, the 0.00136 g/den load was removed and the yarn was allowed to equilibrate at 72% relative humidity for at least 12 hours.

The 0.00136 g/den load was replaced and after 10 seconds the length of the yarn was again measured and recorded as L2.

The 0.00136 g/den load was then removed and replaced with a load of 0.33 g/den and after 10 seconds the final length was measured and recorded as L3.

The bulk, shrinkage, and crimp parameters were then calculated as $$\% \text{ Bulk}=(L1-L2)/(L1)\times 100$$

$$\% \text{ Shrinkage}=(L1-L3)/(L1)\times 100$$

$$\% \text{ Crimp Extension}=(L3-L2)/L3\times 100$$

The % Bulk describes the crimped length compared to the initial length. The % Crimp Extension describes the crimped length compared to the final length. The % Shrinkage describes the permanent change in fiber or yarn length brought about by the heating in the bulking process.

In addition to tests of bulk, shrinkage, and crimp and tests of yarn tensile properties, many applications are aided by a knowledge of the yarn elastic properties. Ladies hosiery is one of several such applications. In this work the yarn elastic properties were measured by the Yam 3 Cycle Extension Test which is described in the following.

The yarn was placed in the jaws of an appropriate tensile tester and tested through the following sequence:

Cycle 1—The yarn was pretensioned in the tensile tester under a load of 0.0012 g/den. It was then extended until the stress on the yarn was 0.2 g/den (in Test A) or 0.1 g/den (in Test B). The elongation to load was noted and the yarn was then allowed to retract to its initial length. Data were generated in this work using both Test A and Test B. Test A and Test B yield results which are numerically different but give the same understanding and are consistent with each other. The cycle 1 elongation to target load is expressed as ELONGA or ELONGB depending upon whether the yarn was tested under Test A or Test B. Then, based upon the first cycle extension and retraction curves, the stress was measured at 86% of the extension to load. The stress in the extension mode was recorded as 1EXTSRA or 1EXTSRB (for Test A or Test B respectively) and the stress in the retraction mode was recorded as 1RETSRA or 1RETSRB (for Test A or Test B respectively).

Cycle 2—In cycle 2 the yarn was again extended to the target load (either 0.2 g/den or 0.1 g/den) and then allowed to retract to its initial length.

Cycle 3—In cycle 3 the yarn was again extended to the target load and held at this extension for 300 sec. At the end of this time the stress on the yarn was recorded and the yarn allowed to again retract to its initial length. Based upon the decay in the stress on the third cycle, the stress after time was measured and recorded as DECASRA or DECASRB (for Test A or Test B respectively). From the third cycle of extension and retraction the stress was measured at 86% of the elongation to load in the extension and recorded as 3EXTSRA or 3EXTSRB (for Test A or Test B respectively). In the retraction mode of the third cycle the stress was measured at 86% of the elongation to load and recorded as 3RETSRA or 3RETSRB (for Test A or Test B respectively).

Many different parameters can be calculated from the data gathered in the 3 cycle extension test. The quantity of raw data is large, and simplifying calculations are used to present the data. The following calculations were found to be particularly useful in calculating yarn parameters:

a. The elongation to load: either ELONGA OR ELONGB
b. The first cycle retraction stress: either 1RETSRA or 1RETSRB
c. The third cycle extension stress: either 3EXTSRA or 3EXTSRB
d. The third cycle retraction stress: either 3RETSRA OR 3RETSRB
e. The stress at the end of the peak decay mode : either DECASRA or DECASRB The following general yarn parameters were then calculated from these measurements:

1. The % Peak Decay=(TL−DECASR)/(TL)×100, where TL=the target load (either 0.1 g/den or 0.2 g/den) and DECASR is the stress after decay on the third cycle for either Test A or Test B.
2. The % Hysteresis Loss=(3EXTSRA−3RETSRA)/(3EXTSRA)×100 for Test A and comparable measurements for Test B.
3. The % Fatigue=(1RETSRA−3RETSRA)/(1RETSRA)×100 for Test A and comparable measurements for Test B.
4. The Stress Elongation Factor SEFA=(3RETSRA)×(ELONGA) for Test A and comparable SEFB for Test B.
5. The Force Elongation Factor FEFA=(SEFA)*(Denier) for Test A and comparable FEFB for Test B.

The most useful parameter describing the elastic properties of yarns is that obtained from the product of the third cycle retraction stress (3RETSRA) and the yarn elongation to load (ELONGA). This product is termed the Stress Elongation Factor: SEFA for Test A and SEFB for Test B. Furthermore, the product of the Stress Elongation Factor and the finished yam denier yields the Force Elongation Factor (FEFA or FEFB). The Force Elongation Factors correlate very well with the force exerted by the finished garment (in the case of ladies hosiery) when the garment is tested by typical garment tests.

It should also be noted that the third cycle retraction stress (3RETSRA or 3RETSRB) has included therein the effects of fatigue (first cycle retraction to third cycle retraction), the effects of hysteresis (third cycle extension to third cycle retraction) and peak decay since retraction stress in the third cycle is measured after the period allowed for stress decay. This third cycle return stress then encompasses the primary effects of stress decay, fatigue, and hysteresis loss all of which are important properties in elastic yarn performance.

The nylon/nylon bicomponent fibers described in the following examples 2, 3, 5, and 6 to 13 and 14 to 17, were all spun at a nominal spinning speed of about 300 meters per minutes with the application of an aqueous fiber finish. The spun yarns were then lagged for about one to several days and then drawtwisted over a draw pin at a nominal draw ratio of about 4 to provide the drawn yarns shown.

EXAMPLES 1 TO 5

COMPARATIVE EXAMPLE 1

A textured 100% nylon 6,6 yarn of yarn denier 18 and 4 filaments was prepared by conventional nylon 6,6 yarn spinning and drawing. This yarn was then friction false twist textured yielding a textured nylon yarn. This yarn sample provided a useful reference point for yam parameters for a typical nylon yarn for ladies stretch hosiery.

COMPARATIVE EXAMPLE 2

A 20 denier 2 filament side by side bicomponent yam was prepared using nylon 6,12 as the homopolyamide (40% by weight of the fiber) and a copolymer of 70% nylon 6,12/30% nylon 6 (60% by weight of the fiber). Such a composition may be within the scope of compositions described in U.S. Pat. No. 3,399,108.

COMPARATIVE EXAMPLE 3

A nylon/nylon side by side bicomponent yam was prepared within the scope of the teachings of Disclosure 19342, Research Disclosures, UK (May 1980). A 24 denier/2 filament yam was made using the nylon 6,6/6, TA copolymer (65%/35% by weight) as the low retraction component and the nylon 6,6/nylon 6/nylon 6,9 (65%/17.5%/17.5% by weight) three component copolymer as the high retraction component.

COMPARATIVE EXAMPLE 4

A series of nylon/polyurethane elastic bicomponent fibers were prepared according to the teachings "Monvelle: New Yarn for Support Hosiery", Knitting Times, Nov. 5, 1973, and "Biconstituent Fibers from Segmented Polyurethane and Nylon 6", J. of Appl. Polym. Sci., v 19, pp 1387–1401, 1975, and U.S. Pat. No. 4,106,313, Aug. 15, 1978.

COMPARATIVE EXAMPLE 5

A side by side nylon/nylon bicomponent fiber was prepared in which one component of the fiber was nylon 6,6 (the low shrinkage component) and the second component was a random four component copolymer (the high shrinkage component) of nylon 6,6/nylon 6/nylon 6,9/nylon 6,10 in the weight ratio of 49.1%: 7.8%: 21.1%: 21.9% respectively (mole % of 47.5: 17.5: 17.5: 17.5).

For many fabric and garment applications, yarns which are removed from the fabrics or garment or which are prepared by a process closely simulating the fabric processing provide the best samples upon which to measure and characterize yam properties. In Examples 1 to 5 such a process was used to simulate end use fabric finishing.

Each yarn in Examples 1 to 5 was knit into a single knit Jersey fabric on a Lawson-Hemphill 3.5 inch circular knitter. The yams evaluated in these examples were fine denier yams suitable for the leg yarn of ladies' hosiery and, in general, were in the range of 20 to 35 denier.

The fabric was then finished through a process which closely resembles the scouring, dyeing, and rinsing steps characteristic of the finishing of ladies hosiery and thereby gives a very good simulation of the properties and characteristics expected of the yam from a fabric processed for this typical end use. Such finishing procedures are well known in the art.

After the fabric finishing step noted above, the fabric was allowed to equilibrate for at least 24 hours at 22° C. and 72% relative humidity.

After fabric conditioning, single ends of the yarn were carefully pulled out of the single knit Jersey fabric (essentially manual deknitting) for subsequent testing of yarn tensile or elastic properties.

Each of these hosiery yarns described in Examples 1 to 5 were knit into fabric, finished, conditioned and removed from the fabric as described above. The yams were then tested for tensile and elastic properties.

The results of the tensile tests are shown in Table 1 and the results of the elastic property tests are shown in Table 2.

TABLE 1

Yarn Tensile Properties

| Yarn Item | Denier/Fils/% HS | Drawn Yarn Denier/BS(g)/ Elong (%) | Finished Yarn Denier/BS (g)/ Elong (%) |
|---|---|---|---|
| Example 1 | 18-4-0 | | 20/91/34 |
| Example 2 | 24-2-60 | 20/118/25 | 26/93/39 |
| Example 3 | 24-2-60 | 23/86/13 | 24/52/33 |
| Example 4-a | 30-1-50 | 31/89/36 | 35/78/64 |
| Example 4-b | 35-3-65 | | 46/72/59 |
| Example 4-c | 35-3-60 | 35/118/36 | 41/84/55 |
| Example 4-d | 24-2-65 | | 31/50/71 |
| Example 5 | 24-2-60 | 24/100/37 | 31/70/57 |

Where: Fils is the number of filaments in the yam; % HS is weight percent high shrinkage component; BS is breaking strength in grams; and Elong (%) is percent elongation at breaking point.

In the course of this work, several different yam items were made, tested and evaluated. It was determined that there was little dependence of the Stress Elongation Factor on yam size (denier) over the range of about 20 denier to 35 denier. However, there were differences in the Stress Elongation Factor (SEF) parameters for yarns tested by Test A or Test B and for yams of the same size (denier) but different numbers of filaments (over the range of 1 to 3) such that the following conversions could be made:

$$SEFA=1.52\times SEFB$$

and $$SEFA\ (1\ filament)=1.15\times SEFA(2\ filament)=1.72\times SEFA(3\ filament)$$

Using these relationships for conversion between Test A and Test B and for conversions among yarns of 1 or 2 or 3 filaments, the data for different yarns were all converted to that of the SEFA parameter for 2 filament yarns. These results on a comparable basis of denier/2 filament yams tested by Test A are termed Normalized Results. The resulting Stress Elongation Factor is termed the Normalized Stress Elongation Factor. Nylon fibers or yarns made by other processes can be compared to the fibers and yarns described in this patent by making such yarns as a 24 denier/2 filament yarn. In such cases the direct results are also the Normalized Results. The term Stress Elongation Factor means those results as obtained by test A.

It will be recognized by those skilled in the art that, in general, the higher stretch and recovery characteristic desired in many fabric applications (such as ladies hosiery) is achieved, in part, by using yarns of fewer filaments and larger denier per filament. For example, common yarns for greater stretch and recovery in hosiery leg yarn are in the range of about 15 to 30 denier with from about 1 to 10 filaments and more typically yams of about 20–25 denier with 2–5 filaments.

As noted above for the yarns of this invention, for yams of constant denier as the number of filaments increases, the Stress Elongation Factor decreases. The relationship between increasing number of filaments and decreasing SEF can be estimated by an appropriate choice of mathematical correlation using the data shown above for the expected relationship among yams of 1 or 2 or 3 filaments.

One correlation for this behavior is a power law relationship for which one can calculate the dependence of SEF on number of filaments as $$F=1.0504(n)\exp(-0.4641)$$

where F is the SEF for a yarn of n filaments compared to the SEF for that same yarn made as a single filament (n=1).

For example a yarn of 10 filaments would be expected to yield a SEF of 0.361 times the SEF of a monofilament of a yarn of the same yam denier, composition and structure.

It will also be obvious to those skilled in the art that the desire for the higher levels of stretch and recovery achieved by fewer filaments (and higher denier per filament) may, in some cases, be balanced by the desire for increased softness achieved by more filaments (and lower denier per filament) so that the final engineered yam may sacrifice some stretch and recovery for softness.

TABLE 2

Yarn Elastic Properties

| Yarn Item | Denier/ Fils/ % HS | Elongation to Load % | Stress at Third Ret (gpd) | SEFA (g/ den)% | SEFB (g/den) | Normalized SEFA (24-2) |
|---|---|---|---|---|---|---|
| Example 1 | 18-4-0 | 131 | .0093 | | 1.2 | 2.8 |
| Example 2 | 24-2-60 | 309 | .0145 | 4.5 | | 4.5 |
| Example 3 | 24-2-60 | 225 | .0138 | 3.2 | | 3.2 |
| Example 4-a | 30-1-50 | 381 | .0132 | | 5.0 | 6.6 |
| Example 4-b | 35-3-65 | 271 | .0122 | | 3.3 | 7.6 |
| Example 4-c | 35-3-60 | 285 | .0168 | 4.8 | | 7.2 |
| Example 4-d | 24-2-65 | 313 | .0138 | | 4.3 | 6.6 |
| Example 5 | 24-2-60 | 287 | .0244 | 7.0 | | 7.0 |

Where: Fils is the number of filaments in the yam; %HS is weight percent high shrinkage component; Elongation to load is the elongation to the 0.1 or 0.2 grams per denier load as described; SEFA and SEFB are the Stress Elongation Factor to the 0.1 or 0.2 grams per denier load, and the normalized SEFA is as described above.

A surprising discovery is that with an appropriate choice of a nylon polymer/copolymer pair and an appropriate spinning and drawing process one can produce a nylon bicomponent yarn which has the stretch, recovery and retractive force characteristics (measured by the Stress Elongation Factor parameter) comparable to that achieved by nylon/polyurethane bicomponents. This level of stretch, recovery, and force is desirable for high force elastic fabrics or garment use such as ladies support hosiery.

It has been determined that a useful range for the SEFA for, for example, woman's hosiery, is at least about 4.5 (g/den)(%), preferably at least about 5.0 (g/den)(%), more preferably at least abut 5.8 (g/den)(%), and even more preferably at least about 6.5 (g/den)(%).

EXAMPLE 6 to 13

Four nylon bicomponent yarns were spun in which two different high shrinkage copolymers were used. In the comparative examples 6, 7, 10, and 11, the "high" shrinkage copolymer was made of nylon 6,6/nylon 6, IA (IA= isophthalic acid) in the ratio by weight of 65%/35% (copolymer C). In Examples 8, 9, 12, and 13, a high shrinkage copolymer was made of nylon 6,6/nylon 6/nylon 6,9 in the ratio by weight of 65%/17.5%/17.5% (copolymer D).

Each of these copolymers was spun as a bicomponent fiber side by side with nylon 6,6 (polymer A) and drawn to provide yarns of 20 denier/2 filaments. Each composition pair was spun as both 50/50 and 60/40 high shrinkage to low shrinkage weight ratios.

Each of the four spun yarns were then drawn to make two different drawn yarn items: the first under conditions of an ambient temperature draw pin and the second under conditions of a draw pin heated to 85° C. The yams were then tested for Crimp Extension as previously described and also knit into a circular knit fabric, finished as described above and tested for elastic properties yielding the data shown in Table 3.

TABLE 3

Comparison of Yarn Properties

| Yarn Code | Yarn Comp./ %HiSh: %LoSh | Draw Pin Temp C. | % Crimp Extension | Stress Elongation Factor (g/den)(%) | Hyster-esis % | Fat-igue % |
|---|---|---|---|---|---|---|
| Comp. Ex. 6 | CA/50:50 | Ambient | 33 | 2.13 | 84 | 67 |
| Comp. Ex. 7 | CA/60:40 | Ambient | 54 | 0.65 | 94 | 83 |
| Ex. 8 | DA/50:50 | Ambient | 47 | 2.28 | 60 | 33 |
| Ex. 9 | DA/60:40 | Ambient | 41 | 3.44 | 57 | 31 |
| Comp. Ex. 10 | CA/50:50 | 85 | 26 | 0.76 | 88 | 77 |
| Comp. Ex. 11 | CA/60:40 | 85 | 45 | 0.85 | 90 | 78 |
| Ex. 12 | DA/50:50 | 85 | 50 | 1.79 | 55 | 40 |
| Ex. 13 | DA/60:40 | 85 | 34 | 2.79 | 49 | 32 |

Although the % Crimp Extension can indicate on a comparative basis a higher level of crimp (Example 7 vs. Example 9), the % Crimp Extension does not necessarily predict or correlate with the more important yarn Stress Elongation Factor, which shows Example 9 significantly higher (better).

Some comparative copolymer compositions (in this case the nylon 6,6/nylon 6, IA), while yielding yams with % Crimp Extension in the range of those yams made with the nylon 6,6/nylon 6/nylon 6,9 copolymer, yield a finished yarn with very much poorer elastomeric properties as indicated by the level of hysteresis loss and fatigue.

Finally, the heated draw pin yielded yarns with lower (poorer) Stress Elongation Factors than the yams produced with the ambient temperature draw pin.

EXAMPLE 14 TO 17

In these Examples copolymers were made of varying molecular weights and spun as bicomponent side by side nylon fibers. Low shrinkage components were spun of both nylon 6,6 (polymer A) and nylon 6,6/6TA copolymers (an isomorphous monomer pair—polymer B). The high shrinkage copolymer (polymer D) was a nylon 6,6/nylon 6/nylon 6,9 in the weight ratio of 65%/17.5%/17.5% respectively. The polymer pairs were spun as both a "medium" viscosity pair and a "high" viscosity pair. The results of this experiment are shown in Table 4. The polymer relative viscosity in sulfuric acid (RVS) was used as the indicator of molecular weight as described previously. In each example the ratio of High Shrinkage component to Low Shrinkage component was 60:40. The yarns were knit into circular knit fabrics, finished, and then deknit and tested as described previously.

TABLE 4

Relative Viscosity in Sulfuric Acid Versus SEFA

| Example No. | Polymer Pair | RVS of High Shrinkage Component | RVS of Low Shrinkage Component | SEFA (g/den)(%) |
|---|---|---|---|---|
| Example 14 | DA | 2.68 | 2.51 | 3.04 |
| Example 15 | DA | 3.56 | 3.33 | 6.87 |
| Example 16 | DB | 2.74 | 2.35 | 4.12 |
| Example 17 | DB | 3.23 | 2.85 | 6.32 |

The important learning from the data in Table 4 is that increased polymer molecular weight, as evidenced by the RVS, can have a marked effect on the Stress Elongation Factor. It is preferred that both the low shrinkage and high shrinkage components have an average RVS greater than about 2.3, preferably 2.8 and more preferably at least about 3.2.

These examples illustrate the effects of polymer compositions, polymer molecular weights, and yam making processes (particularly drawing) which provide for making nylon bicomponent yams of higher Stress Elongation Factor levels than previously achieved.

What is claimed is:

1. A nylon bicomponent yam comprising, one low shrinkage nylon component comprising a nylon homopolymer or a nylon copolymer of isomorphic monomers, and one high shrinkage nylon component comprising a random copolyamide, which comprises at least two mutually non-isomorphic nylon comonomer units, said yarn comprising a Stress Elongation Factor of at least about 4.5 (g/den)(%).

2. The yarn of claim 1, wherein the high shrinkage nylon component comprises a random copolyamide comprising at least three mutually non-isomorphic comonomer units.

3. The yarn of claim 1, wherein the low shrinkage component comprises nylon 6,6.

4. The yarn of claim 1, wherein the high shrinkage nylon component is comprised of nylon 6,6, nylon 6, and nylon 6,9.

5. The yarn of claim 1, wherein the high shrinkage nylon component is comprised of nylon 6,6, nylon 6, nylon 6,9, and nylon 6,10.

6. The yarn of claim 1, wherein the high shrinkage nylon component comprises no comonomer at a concentration greater than about 65% by weight.

7. The yarn of claim 1, wherein the components are arranged in a side by side configuration.

8. The yarn of claim 1, wherein the yarn comprises two or more filaments wherein at least one of which has a denier per filament greater than 5.0.

9. The yarn of claim 1, wherein the low shrinkage nylon component comprises isomorphic comonomers.

10. The yarn of claim 1, wherein the high shrinkage nylon component comprises no comonomer at a concentration greater than about 55% by weight.

11. The yarn of claim 1, wherein at least one of the nylon components comprises an average Relative Viscosity in Sulfuric Acid of at least about 2.8.

12. The yarn of claim 1, wherein at least one of the nylon components comprises an average Relative Viscosity in Sulfuric Acid of at least about 3.2.

13. The yarn of claim 1, wherein the yarn comprises a Stress Elongation Factor of greater than about 5.2 (g/den) (%).

14. The yarn of claim 1, wherein the yarn comprises a Stress Elongation Factor of greater than about 6.0 (g/den) (%).

15. The yarn of claim 1, wherein the high shrinkage nylon component comprises three comonomers, wherein the most abundant comonomer is between about 33.3 and 65 weight percent, the next most abundant comonomer is between about 17.5 and about 42.5 weight percent, and the least abundant comonomer is present at between about 15 and about 33.3 weight percent, based on the weight of the comonomers.

16. The yarn of claim 1, wherein the high shrinkage nylon component comprises four comonomers, wherein the most abundant comonomer is between about 25 and 65 weight percent, the next most abundant comonomer is between about 11.7 and about 46 weight percent, the third most abundant comonomer is between about 4 and about 32 weight percent, and the least abundant comonomer is present at between about 4 and about 25 weight percent, based on the weight of the comonomers.

17. A nylon bicomponent yarn comprising, one low shrinkage nylon component comprising a nylon homopolymer or a nylon copolymer of isomorphic monomers, and one high shrinkage nylon component comprising a random copolyamide comprised of nylon 6,6, nylon 6, and nylon 6,9 wherein the most abundant comonomer is between about 33.3 and 65 weight percent, the next most abundant comonomer is between about 17.5 and about 42.5 weight percent and the least abundant comonomer is present at between about 15 and about 33.3 weight percent, based on the weight of the comonomers, said yarn comprising a Stress Elongation Factor of at least about 4.5 (g/den) (%).

18. A nylon bicomponent yarn comprising, one low shrinkage nylon component comprising a nylon homopolymer or a nylon copolymer of isomorphic monomers, and one high shrinkage nylon component comprising a random copolyamide comprised of nylon 6,6, nylon 6, nylon 6,9, and nylon 6,10 wherein the most abundant comonomer is between about 25 and 65 weight percent, the next most abundant comonomer is between about 11.7 and about 46 weight percent, the third most abundant comonomer is between about 4 and about 32 weight percent, and the least abundant comonomer is present between about 4 and about 25 weight percent, based on the weight of the comonomers, said yarn comprising a Stress Elongation Factor of at least about 4.5 (g/den)(%).

* * * * *